US006261639B1

(12) United States Patent
Shibata et al.

(10) Patent No.: US 6,261,639 B1
(45) Date of Patent: Jul. 17, 2001

(54) PROCESS FOR HOT-ROLLING STAINLESS STEEL

(75) Inventors: Hiromitsu Shibata; Seiji Itoyama; Kenichi Sorimachi, all of Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/273,530

(22) Filed: Mar. 22, 1999

(30) Foreign Application Priority Data

Mar. 31, 1998 (JP) ..... 10-087397

(51) Int. Cl.[7] ..... B05D 3/12; B05D 3/02; B21B 45/00

(52) U.S. Cl. ..... 427/383.7; 427/366; 427/370; 427/376.4; 427/383.7; 427/327; 72/39; 72/46; 72/365.2

(58) Field of Search ..... 427/366, 370, 427/376.4, 383.7, 327; 148/708, 28; 72/39, 46, 365.2

(56) References Cited

U.S. PATENT DOCUMENTS

| | | | | |
|---|---|---|---|---|
| 2,786,782 | * | 3/1957 | Zimmerman et al. | 117/70 |
| 3,180,764 | | 4/1965 | Timmins et al. . | |
| 3,663,313 | * | 5/1972 | Oberly et al. | 148/23 |
| 3,765,205 | * | 10/1973 | Schaumburg | 72/46 |
| 3,950,575 | * | 4/1976 | Kitayama et al. | 427/226 |
| 3,959,028 | * | 5/1976 | Jackson | 148/11.5 R |
| 4,255,205 | | 3/1981 | Morito et al. . | |
| 5,346,634 | * | 9/1994 | Sawazaki et al. | 252/30 |
| 5,492,575 | * | 2/1996 | Teraoka et al. | 148/542 |

FOREIGN PATENT DOCUMENTS

| | | |
|---|---|---|
| 54-157712 | 12/1979 | (JP) . |
| 60-141821 | 7/1985 | (JP) . |
| 61-127823 | 6/1986 | (JP) . |
| 8-049018 | 2/1996 | (JP) . |

* cited by examiner

*Primary Examiner*—Shrive Beck
*Assistant Examiner*—Michael Barr
(74) *Attorney, Agent, or Firm*—Young & Thompson

(57) ABSTRACT

A hot-rolling process prevents surface deterioration of the stainless steel sheet which forms during hot rolling of a stainless steel slab after heating in a heating furnace, and does not cause damage to the heating furnace nor a decrease in yield of the steel sheet. The hot-rolling process for a stainless steel slab includes heating a stainless slab containing 10 weight percent or more of chromium in a heating furnace and hot-rolling the slab. A surface treatment, which is used prior to the heating, composition is composed of a mixture containing at least one of a Ca compound and a Ba compound and a binder for binding the mixture to a slab surface and for forming a coating film on a slab surface.

15 Claims, 2 Drawing Sheets

PROCESS FOR HOT-ROLLING STAINLESS STEEL

BACKGROUND OF THE INVENTION

1. Field of the Invention

The present invention relates to a process for hot rolling stainless steel that does not damage the surface of the rolled product and thus improves product yield when a steel slab is heated in a heating furnace and is then hot-rolled.

2. Description of the Related Art

Oxide scale formed during a rolling process functions as a lubricant between a working roll and a workpiece to be rolled. However, during hot rolling of stainless steel, oxide scale generally forms to a lesser extent on the steel slab surface, such that ductility of the oxide scale is inferior to that of plain steel. Thus, seizing more readily occurs between the working roll and the workpiece during hot rolling of stainless steel. The seizing increases the roughness of the working roll surface due to heat scratches, and that roughness is transferred to the surface of the workpiece. As a result, the hot-rolled product has surface defects (sometimes called "surface deterioration").

In stainless steel containing at least one element selected from the group consisting of Al, Mo, Ti, and Nb in a total amount of at least about 0.2 weight percent, and in stainless steel containing Cr in an amount of about 16 weight percent, the thickness of the oxide scale before hot rolling is only several microns and is thus especially small. Since the oxide scale has poor ductility due to a high Cr content, seizing between the working roll and the workpiece occurs often.

Since stainless steel sheets used in exterior materials must have a beautiful surface finish, the above-described surface deterioration is corrected by surface grinding or the like of the steel sheets. Such additional treatment, however, incurs high production cost and causes a significantly decreased yield.

Japanese Patent Application Laid-Open No. 2-132190 discloses a method for preventing seizing between a working roll and a workpiece to be rolled using a hot rolling lubricant in rolling of such types of steel.

The present inventors have discovered a method for suppressing seizing between a working roll and a workpiece to be rolled, and thus preventing surface deterioration of the steel sheet. In this method, oxidation is moderately enhanced to form a relatively thick, low-chromium surface layer (a surface layer having a decreased chromium content due to enhanced oxidation of chromium) of the workpiece during heating in a heating furnace before hot rolling.

A method for promoting oxidation of the steel slab which relates to the present method is disclosed in Japanese Patent Application Laid-Open No. 58-138501, in which the defects on the surface of a steel slab are removed as scales by enhanced oxidation so that a steel sheet having superior surface quality is obtained without the need for refinishing by grinding. In this method, a melt of $CaCl_2$, NaCl, or $V_2O_5$ is adhered to the slab surface of heated plain steel, or to parts of the slab surface to be refinished, in order to remove surface defects by enhanced oxidation. Furthermore, Japanese Patent Application Laid-Open No. 8-49018 discloses a method for removing surface defects on a steel slab by enhanced oxidation, in which oxides and/or inorganic and organic salts of alkaline metals and alkaline earth metals are applied to the slab surface at a rate of 100 $g/m^2$ or more before a high-alloy steel containing 18 weight percent or more of chromium is placed in a heating furnace prior to hot rolling, and the steel is then heated at a temperature of at least 1,200° C. for at least 30 minutes in an oxidizing atmosphere so as to remove surface defects on the steel slab by enhanced oxidation.

The above-mentioned methods, however, have the following problems.

(1) Problems in Use of a Hot-rolling Lubricant

Failure in biting may occur during the actual hot rolling operation when there is a large biting angle for the workpiece to be rolled by a working roll, as occurs in a rough mill and in a preceding stage of a finishing mill; hence, use of the hot-rolling lubricant is generally suspended during biting. As a result, seizing occurs between the working roll and the workpiece at portions where the hot-rolling lubricant is not used. Accordingly, the surface roughness of the resulting steel sheet increases due to roughening of the rolled surface.

(2) Problems in Conventional Processes for Promoting Oxidation of Steel Slabs

In the conventional processes disclosed in Japanese Patent Application Laid-Open Nos. 58-138501 and 8-49018, a surface treatment composition is used for promoting oxidation on a steel slab, but no attention whatsoever is given to maintaining adhesion of the surface treatment composition to the steel slab until oxidation of the steel slab by the surface treatment composition is completed in a heating furnace. Thus, the surface treatment composition is scraped off by a transfer roll or a steel slab support or becomes detached therefrom by vibration during transfer when the slab is moved after coating and is placed into the heating furnace. Accordingly, sufficient oxidation effects are not achieved at the corresponding portions.

When these conventional processes are used for preventing surface deterioration in a hot rolling process, seizing occurs between a working roll and insufficiently oxidized portions of a workpiece. Since the working roll surface is rapidly damaged, surface deterioration of the steel sheet cannot be prevented.

When the surface treatment composition disclosed in Japanese Patent Application Laid-Open No. 58-138501 is used for preventing surface deterioration of stainless steel containing 10 weight percent or more of chromium, unlike in plain steel, the chromium content in the low-chromium layer does not substantially decrease, due to insufficient oxidation, regardless of the adhesion of a typical melt such as NaCl or $V_2O_5$. When $CaCl_2$ is applied, the thickness of the low-chromium layer on the workpiece surface is small in spite of the progress of oxidation, and thus formation of scale during hot rolling is insufficient to effectively prevent surface deterioration (details will be described below).

When the surface treatment composition disclosed in Japanese Patent Application Laid-Open No. 8-49018 is used, surface treatment compositions other than Ca-based surface treatment compositions and Ba-based surface treatment compositions do not cause sufficient oxidation. Furthermore, application of the Ca-based surface treatment compositions and Ba-based surface treatment compositions also does not sufficiently prevent surface deterioration due to an insufficient thickness of the low-chromium layer.

Furthermore, in these conventional processes, oxidation continues rapidly in the heating furnace so that the thickness of the formed scale reaches 1 mm or more; hence, a decreased product yield causes increased production cost. Since these conventional surface treatment compositions cause vigorous oxidation of a steel slab support that bears the steel slab in the heating furnace during heating, rapid damage to the steel slab support results in a decreased rate of operation in the hot-rolling facility.

SUMMARY OF THE INVENTION

It is an object of the present invention to provide a hot rolling process for stainless steel which does not cause surface deterioration of a hot-rolled product, improves the product yield, and prevents damage to a steel slab support when a stainless steel slab is heated in a heating furnace and is then hot-rolled.

The present inventors have developed the present invention on the basis of the following effects (1) to (7) which they have discovered during a comprehensive study to solve the problems in the conventional processes.

(1) Prevention of Surface Roughness by Enhanced Adhesion of Surface Treatment Composition to Steel Slab Surface Surface treatment compositions have typically been applied to steel slabs by forming a slurry of the surface treatment composition dispersed in a solvent such as water, applying the slurry using a brush or spray to the surface of the slab, and transferring the slab into a heating furnace after being dried; or by directly blowing a powdered surface treatment composition (without using a solvent) onto a heated steel slab so that the surface treatment composition is adhered to the steel slab as a melt, and transferring the slab into a heating furnace. Ca-based and Ba-based surface treatment compositions, however, display poor adhesion to the steel slab when they are used alone; hence, the surface treatment compositions are locally detached from the slab by friction between raised portions of the slab and a transfer roll, as well as by vibration of the slab when the slab is transferred to the transfer roll. The detached portions then seize with the working roll during rolling, and thus damage the working roll.

The present inventors conceived various countermeasures to this problem and conducted tests to confirm the effects of the countermeasures. The conclusion of the present inventors is that addition of a binder to a surface treatment composition is the most inexpensive and effective method. Any binder enhancing adhesion of the surface treatment composition to a steel slab can be used. When the surface treatment composition is applied to the steel slab as a sprayed solvent-based slurry, the surface treatment composition preferably has low or moderate solubility in the solvent, forms a coating film after drying of the slurry, and maintains its adhesiveness until the surface treatment composition reacts with the underlying steel. When a powdered surface treatment composition is sprayed directly onto a heated steel slab (without using a solvent), thereby to melt the surface treatment composition on the steel slab, the melt preferably has high viscosity in order to prevent dripping of the adhered melt. A preferred example of a surface treatment composition satisfying these conditions is an oxide frit containing silicate or borosilicate, which are relatively inexpensive ingredients.

(2) Melting of $Cr_2O_3$ Passivating Film by Ca or Ba Compound

The present inventors have studied enhanced oxidation by various surface treatment compositions, and have discovered that in stainless steel containing 10 weight percent or more of chromium, the $Cr_2O_3$ film on the heated steel surface loses its antioxidation properties when a surface treatment composition containing at least one compound selected from a Ca compound and a Ba compound is applied. This effect may be explained based on the reaction of the $Cr_2O_3$ passivating film with Ca and/or Ba compounds. This enhanced oxidation effect by the Ca and Ba compounds is quite different from the adhesive effect of the melt disclosed in Japanese Patent Application Laid-Open No. 58-138501, because the melting points of calcium oxide (CaO: 2,570° C.) and barium oxide (BaO: 1,920° C.), which greatly enhance oxidation among the Ca and Ba compounds, are significantly higher than the temperatures (1,000 to 1,300° C.) in a typical heating furnace and because $V_2O_5$ and NaCl disclosed in Japanese Patent Application Laid-Open No. 58-138501 do not facilitate oxidation.

(3) Increase in Thickness of Low-chromium Layer by Addition of Si or B Compound to Surface Treatment Composition With reference to FIG. 1, it is generally known that a $Cr_2O_3$ passivating film 4 firmly formed on stainless steel causes a noticeable decrease in the oxidation rate. Thus, the chromium content in the low-chromium layer 3' in the metal surface layer just below the $Cr_2O_3$ passivating film 4 is preserved. When a chemical such as a Ca compound or a Ba compound is applied, the $Cr_2O_3$ passivating film is melted by the reaction with the surface treatment composition, resulting in significantly decreased antioxidant characteristics. In such a case, as shown in FIG. 3, a very thick Fe—Cr-based oxide layer 2 is formed, while a low-chromium layer 3 having a very low chromium content is formed between the Fe—Cr-based oxide layer 2 and the internal metal layer 5 in which the chromium content is not reduced. Since the oxidation rate is very high, large amounts of chromium and iron are oxidized. When an optimum amount of an Si compound or a B compound is added to the surface treatment composition, oxidation of iron is significantly suppressed compared to oxidation of chromium. Thus, as shown in FIG. 2, the thickness of the Fe—Cr-based oxide layer 2 decreases, whereas the thickness of the low-chromium layer 3 increases.

With reference to FIGS. 1 to 3, when the surface treatment composition is used, a layer 1 formed of the surface treatment composition, the oxide flux, and the Fe—Cr-based oxide is formed on the Fe—Cr-based oxide layer 2. When the surface treatment composition is not used, the oxide flux 6 remains only partially on the $Cr_2O_3$ passivating film 4.

Such a overoxidation is noticeably reduced when the content of calcium or barium oxide is slightly lowered such that the converted weight ratio $\{(CaO)+(BaO)\}/\{(SiO_2)+(B_2O_3)\}$ in the surface treatment composition is 10 or less with respect to the Ca, Ba, Si and B contents, although the mechanism causing this effect is not clear. When a large amount of Si or B compound is added such that the converted weight ratio $\{(CaO)+(BaO)\}/\{(SiO_2)+(B_2O_3)\}$ is less than 2, the $Cr_2O_3$ passivating film will not melt. Thus, oxidation is not enhanced and the chromium content in the low-chromium layer does not decrease. Accordingly, the surface deterioration of the steel sheet is not substantially suppressed.

(4) Suppression of Surface Deterioration by Increasing Thickness of Low-chromium Layer In hot-rolling processes, a steel slab is typically subjected to descaling to remove foreign materials and oxide scale adhering to the slab surface. Most of the oxide scale layer formed in the heating furnace is thereby removed. Thus, most of oxide scale on the workpiece surface is formed during the hot-rolling process. The rate of formation of the oxide scale during rolling increases as the chromium content decreases; hence, formation of a thick low-chromium layer can maintain a large oxidation rate through the second half of the hot-rolling process. Although the thickness of the scale decreases in response to the rolling performed during the second half of the rolling process, seizing between the working roll and the workpiece can nevertheless be prevented when a high oxidation rate continues through the second half of the hot-rolling process.

(5) Increased Thickness of Low-chromium Layer by Addition of Fe or Li Compound to Surface Treatment Composition Since a much smaller amount of oxide scale is formed during casting of stainless steel compared to plain steel, a flux which is used as a surface coating material for suppressing oxidation during casting remains with the oxide scale on the slab surface after casting. The oxide flux will persist locally in amounts of several tens of $g/m^2$ or more in some cases, although the amount depends on the type of steel. The oxide flux typically consists essentially of $SiO_2$ and CaO. Since the ratio $\{(CaO)+(BaO)\}/\{(SiO_2)+(B_2O_3)\}$ is generally in a range of approximately 0.5 to 1.0, the oxide flux cannot melt the $Cr_2O_3$ passivating film. The surface treatment composition does not directly contact the $Cr_2O_3$ passivating film at portions in which several tens of $g/m^2$ or more of oxide flux are adhered. Thus, the $Cr_2O_3$ passivating film cannot be melted.

It is known that a residual Fe or Li compound causes a decrease in the melting point of CaO—$SiO_2$-type oxide, such as oxide flux. A surface treatment composition containing an Fe or Li compound can melt the oxide flux remaining on the $Cr_2O_3$ passivating film during the heating step; hence the Ca, Ba, Si and B compounds can interact with the $Cr_2O_3$ passivating film. Furthermore, the Fe or Li compound decreases the melting point of the applied surface treatment composition; hence, the contact state between the surface treatment composition and the $Cr_2O_3$ passivating film is changed from a relatively inactive solid-solid contact state to a relatively more active liquid-solid contact state. Thus, more uniform oxidation is achieved on the slab surface. Accordingly, surface deterioration of the steel sheet after hot rolling is largely prevented even for steel slabs having several tens of $g/m^2$ of adhered oxide flux.

(6) Removal of Oxide Flux Prior to Coating of Surface Treatment Composition

As described above, addition of a substance, such as an Fe or Li compound, which decreases the melting point of oxide remaining on the steel slab surface, is effective to prevent deterioration of the effect of the surface treatment composition by the oxide flux; however, when there is an especially large amount of adhered oxide flux, the effect may not be satisfactory.

In such a case, the oxide flux is removed in a pretreatment step prior to the coating of the surface treatment composition to effectively prevent surface deterioration of the hot-rolled steel sheet.

(7) Increase in Thickness of Low-chromium Layer by Decreasing Heating Temperature In general, when the temperature of the heating furnace is increased, the high-temperature strength of the workpiece to be rolled is reduced. Thus, the rolling force during hot rolling can be reduced and seizing between the workpiece and the working roll decreases. This technique, however, is not generally employed since it has some disadvantages, for example, high heating cost and short furnace life. For a steel slab to which a surface treatment composition is applied, oxidation of iron can be suppressed and a thick low-chromium layer can be formed when the heating temperature is limited to less than 1,200° C., as in the case of addition of a Si compound and a Bi compound. Thus, the formation of scale which functions as a lubricant is enhanced on the workpiece surface, although the rolling force increases during hot-rolling. As a result, surface deterioration is further suppressed.

In the present invention, therefore, a process for hot-rolling a stainless steel slab comprises heating a stainless steel slab containing at least about 10 weight percent chromium in a heating furnace and then hot-rolling the slab; wherein, prior to heating, a surface treatment composition is applied to a surface of the slab, the composition comprising a mixture of (a) at least one of a Ca compound and a Ba compound and (b) a binder for binding the mixture to a slab surface and for forming a coating film.

The stainless steel may contain at least one element selected from the group consisting of aluminum, molybdenum, titanium, and niobium, in a total amount of at least about 0.2 weight percent.

The stainless steel preferably contains at least about 16 weight percent chromium.

Preferably, the binder contains at least one substance selected from the group consisting of Si compounds and B compounds.

Preferably, the Si compound is a silicate and the B compound is a borosilicate.

Preferably, the surface treatment composition has a composition satisfying the relationship (1):

$$2 \leqq \{(CaO)+(BaO)\}/\{(SiO_2)+(B_2O_3)\} \leqq 10 \quad (1)$$

wherein (CaO), (BaO), ($SiO_2$), and ($B_2O_3$) indicate Ca, Ba, Si, and B contents by weight percent as oxides converted from the Ca, B, Si and B compounds, respectively.

Expressed in terms of elemental Ca, Ba, Si and B, the above relationship (1) is as follows:

$$2 \leqq (1.4Ca+1.1Ba)/(2.1Si+3.2B) \leqq 10,$$

wherein Ca, Ba, Si and B indicate the elemental Ca, Ba, Si and B contents by weight percent contained in the surface treatment composition, respectively.

Preferably, the surface treatment composition contains at least one of an Fe compound and a Li compound so as to satisfy the relationship (2):

$$0.02 \leqq \{(Fe_2O_3)+(Li_2O)\}/\{(CaO)+(BaO)+(SiO_2)+(B_2O_3)+(Fe_2O_3)+(Li_2O)\} \leqq 0.3 \quad (2)$$

wherein (CaO), (BaO), ($SiO_2$), ($B_2O_3$), ($Fe_2O_3$), and ($Li_2O$) indicate Ca, Ba, Si, B, Fe, and Li contents by weight percent as oxides converted from the Ca, Ba, Si, B, Fe, and Li compounds, respectively.

Expressed in terms of elemental Fe, Li, Ca, Ba, Si and B, the above relationship (2) is as follows:

$$0.02 \leqq (1.4Fe+2.2Li)/(1.4Ca+1.1Ba+2.1Si+3.2B+1.4Fe+2.2Li) \leqq 0.3,$$

wherein Ca, Ba, Si, B, Fe and Li indicate the elemental Ca, Ba, Si, B, Fe and Li contents by weight percent contained in the surface treatment composition, respectively.

Preferably, the surface treatment composition is applied after the oxide flux adhered to the slab surface is removed.

Preferably, the stainless steel slab is heated to a temperature less than about 1,200° C.

DESCRIPTION OF PREFERRED EMBODIMENTS

Figure 1:
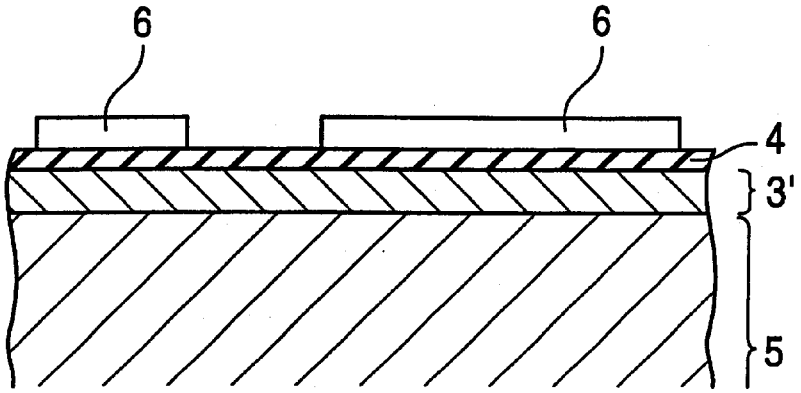
FIG. 1 is a cross-sectional view of a layered structure of a stainless steel slab, which structure is formed after the slab is placed into a heating furnace when a surface treatment composition of the present invention is not used.
Figure 2:
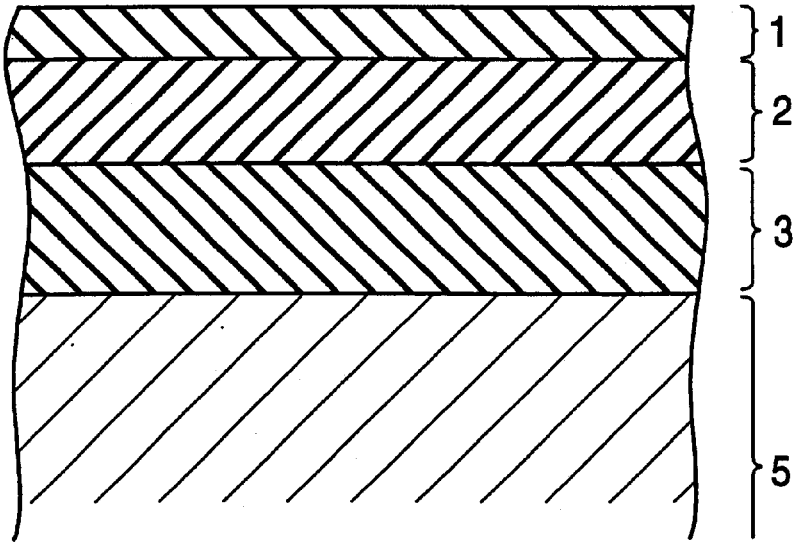
FIG. 2 is a cross-sectional view of a layered structure of a stainless steel slab, which structure is formed after the slab is placed into a heating furnace when a surface treatment composition of the present invention is used.
Figure 3:
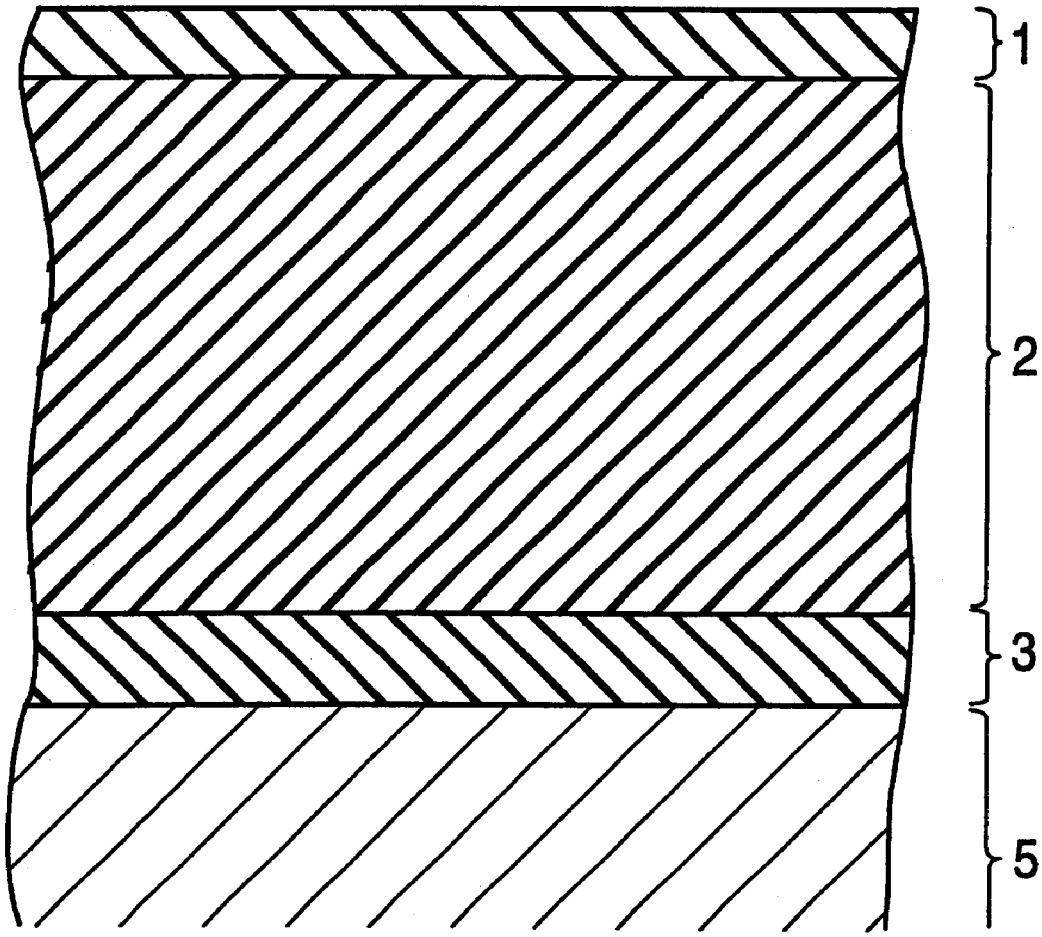
FIG. 3 is a cross-sectional view of a layered structure of a stainless steel slab after the slab is placed into a heating furnace when a Ca compound or a Ba compound alone is used.

In accordance with the present invention, in the course of hot rolling a stainless steel slab containing 10 weight percent or more of chromium, a surface treatment composition such as a Ca compound and/or a Ba compound is applied to the slab surface together with a binder which adheres to the slab surface, prior to heating performed before the subsequent hot rolling. Since the Ca compound and/or the Ba compound do not detach from the slab during transfer of the slab, the surface treatment composition facilitates oxidation of the entire slab surface. A low-chromium layer is therefore formed on the entire surface of the heated steel slab. Since the oxide scale formed on the entire surface of the workpiece in a large amount suppresses seizing between the workpiece and the working roll, an increase in the roughness of the working roll is suppressed, and thus the resulting hot-rolled steel sheet does not suffer surface deterioration.

Any binder providing strong adhesion in this environment can be used in the present invention. A preferred binder is an inexpensive frit containing silicates, such as water glass ($Na_2O.nSiO_2$ wherein n=1 to 4), and borosilicates, such as $Na_2O.nSiO_2.mB_2O_3$, as primary components.

When a Si compound and/or a B compound are also included in the above surface treatment composition, the oxidation rate in the heating furnace decreases compared to the case of using only a Ca compound and/or a Ba compound. In particular, oxidation of iron is more effectively suppressed compared to oxidation of chromium; hence, a thick low-chromium layer is formed. As the result since the fast rate of the oxidation is maintained through the second half of the hot rolling, the working roll does not cause seizing during the hot rolling. Since vigorous oxidation of iron is prevented in the heating furnace, a high yield is also achieved.

When the ratio of the Si and B compounds to the Ca and Ba compounds is too low, oxidation of iron is not effectively suppressed. On the other hand, when the ratio is too high, the $Cr_2O_3$ passivating film on the slab surface is not melted. Accordingly, the composition of the surface treatment composition is preferably represented by the relationship (1):

$$2 \leqq \{(CaO)+(BaO)\}/\{(SiO_2)+(B_2O_3)\} \leqq 10 \quad (1)$$

wherein (CaO), (BaO), ($SiO_2$), and ($B_2O_3$) indicate Ca, Ba, Si, and B contents by weight percent as oxides converted from the Ca, B, Si and B compounds, respectively, in the surface treatment composition.

Oxidation of iron is more effectively suppressed when the steel slab provided with the applied surface treatment composition is heated to a temperature less than 1,200° C. An increase in oxide scale on the workpiece surface due to an increase in the thickness of the low-chromium layer can suppress surface deterioration of the steel sheet regardless of a slight increase in rolling force during the hot rolling.

In stainless steel, oxide flux used during casting remains in part on the slab surface and inhibits direct reaction of the surface treatment composition, such as a Ca compound or a Ba compound, with the $Cr_2O_3$ passivating film. When a melting-point lowering agent, such as an Fe compound or a Li compound, is mixed with the surface treatment composition, the mixture melts the residual solid oxide flux so that the underlying $Cr_2O_3$ passivating film reacts more fully with the surface treatment composition. Preferably, the Fe compound and the Li compound are added so as to satisfy the relationship (2):

$$0.02 \leqq \{(Fe_2O_3)+(Li_2O)\}/\{(CaO)+(BaO)+(SiO_2)+(B_2O_3)+(Fe_2O_3)+(Li_2O)\} \leqq 0.3 \quad (2)$$

wherein (CaO), (BaO), ($SiO_2$), ($B_2O_3$), ($Fe_2O_3$), and ($Li_2O$) indicate Ca, Ba, Si, B, Fe, and Li contents by weight percent as oxides converted from the Ca, Ba, Si, B, Fe, and Li compounds, respectively. That is, a preferred content, represented by the reduced oxide content, of the Fe and Li compounds is in a range of 2 to 30 weight percent of the total content as oxides of the Ca, Ba, Si, B, Fe and Li compounds. A content of less than 2 weight percent does not significantly decrease the melting point of the surface treatment composition, whereas a content of more than 30 weight percent causes a saturated decrease in the melting point.

When an especially great amount of oxide flux is adhered to the steel slab, the advantages of the present invention may not be achieved. An effective countermeasure in such a case is pretreatment for removing the oxide flux on the slab surface by high-pressure descaling or shot blasting.

EXAMPLES

The present invention will now be described in more detail with reference to the following EXAMPLES.

Ten types of molten steel (Nos. 1 to 10) shown in Table 1 were cast under the following conditions to prepare cast slabs.

Casting Conditions

- Casting apparatus: a continuous casting system (length: 25.6 m)
- Composition of mold flux (oxide flux): $CaO/SiO_2$ ratio by weight=1
- Casting speed: 0.7 to 1.3 m/min
- Shape of slab: width=1,080 to 1,260 mm, thickness=200 mm, length=7 m Each aqueous slurry of a surface treatment composition (Nos. 1 to 26) having the composition shown in Table 2 was applied by spraying onto two faces of any one of the resulting steel slabs at an inlet site of a heating furnace. Some steel slabs were subjected to shot blasting before the coating of the surface treatment composition to remove the oxide flux remaining on the slab surface.

Coating Conditions of Surface Treatment Composition

- Surface temperature of slab to be coated: 200 to 450° C.
- Coating density of surface treatment composition: 100 to 300 $g/m^2$ Slabs coated with surface treatment compositions and uncoated slabs were heated in a heating furnace under the following conditions.

Operation Conditions of Heating Furnace

- Surface temperature of slab when it is placed in furnace: 100 to 350° C.
- Heating temperature: 1,170 to 1,240° C.
- Holding time in furnace: 140 to 160 minutes Each heated slab was hot-rolled under the following conditions. In one hot-rolling cycle, ten to twelve coils were produced. In the same hot-rolling cycle, only one type of slab was hot-rolled in which parameters determining the type of the slab were the type of the steel, the type of the surface treatment composition, shot blasting, and heating temperature. Before another type of slab was hot-rolled, the working roll was replaced with a new one.

Hot-rolling Conditions

- Roughening mill: seven passes
- Finishing mill: seven stands
- Rolling oil: not used Thickness of steel sheet at inlet site of finishing mill: 30.4 mm Thickness of steel sheet at outlet site of finishing mill: 3.0 mm The hot-rolled steel sheet was annealed and then acid-washed to examine the surface defect rate (%)={(number of coils having a defect)/(total number of examined coils)}×100. The yield in the hot-rolling process was determined by a difference between the slab weight before heating and the coil weight after rolling. The results are shown in Tables 3 and 4.

Tables 3 and 4 establish that surface deterioration of hot-rolled stainless steel sheets is effectively suppressed by coating a mixture onto the slab surfaces, in which the mixture contains at least one substance selected from a Ca compound and a Ba compound and at least one substance selected from a Si compound and a B compound and has a suitable composition. When the Si or B compound is a binder such as a silicate or a borosilicate, surface deterioration is further suppressed. Also, addition of an Fe or Li compound, removal of oxide flux prior to coating of a surface treatment composition, and a decrease in the heating temperature can effectively and reliably suppress surface deterioration of the steel sheet.

When a surface treatment composition in accordance with the present invention is used, the yield is significantly higher than that when surface treatment compositions of the comparative examples (Nos. 1, 2, 3, 4, 6, 8, 10, and 11) are used.

The extent of damage to a slab holder in the heating furnace was observed for each surface treatment composition. When the surface treatment compositions of the comparative examples (Nos. 1, 2, 3, 4, 6, 8, 10, and 11) were used, a maximum indented section of 0.7 mm was formed by erosion on the holder which came into contact with the steel slab. Such damage, however, did not occur when surface treatment compositions in accordance with the present invention were used. Accordingly, the surface treatment composition in accordance with the present invention does not cause damage to the slab holder in the heating furnace.

In accordance with the present invention, the hot-rolling process of the stainless steel slab does not cause significant surface deterioration of the steel sheet, while a high yield in the hot-rolling process is achieved. Thus, the resulting steel sheet does not require a surface polishing process and is produced at a high yield.

Since the hot-rolling method in accordance with the present invention does not cause damage to the slab holder in the heating furnace, the net working rate of the hot-rolling facility is further improved.

TABLE 1

Steel used in the EXAMPLES

| Steel No. | C | Si | Mn | Ni | Cr | Al | Mo | Ti | Nb | Al + Mo + Nb + Ti |
|---|---|---|---|---|---|---|---|---|---|---|
| 1 | 0.012 | 0.2 | 1.5 | 0.3 | 10.9 | 0.01 | <0.05 | <0.05 | <0.01 | <0.2 |
| 2 | 0.06 | 0.32 | 0.65 | 0.3 | 16.2 | <0.01 | <0.05 | <0.05 | <0.01 | <0.2 |
| 3 | 0.008 | 0.25 | 0.3 | <0.2 | 11.0 | 0.02 | <0.05 | 0.25 | <0.01 | 0.27 |
| 4 | 0.004 | 0.1 | 0.3 | <0.2 | 16.5 | 0.01 | 0.85 | <0.05 | 0.22 | 1.08 |
| 5 | 0.012 | 0.4 | 0.3 | <0.2 | 17.25 | 0.01 | <0.05 | <0.05 | 0.42 | 0.43 |
| 6 | 0.003 | 0.06 | 0.15 | <0.2 | 17.8 | 0.025 | 1.45 | 0.13 | <0.01 | 1.61 |
| 7 | 0.004 | 0.3 | 0.15 | <0.2 | 19 | 0.015 | 1.9 | <0.05 | 0.27 | 2.19 |
| 8 | 0.003 | 0.1 | 0.1 | <0.2 | 19.5 | 5.7 | <0.05 | <0.05 | <0.01 | <0.2 |
| 9 | 0.05 | 0.55 | 1.02 | 0.3 | 18.2 | <0.01 | <0.05 | <0.05 | <0.01 | <0.2 |
| 10 | 0.06 | 0.8 | 1.6 | 19.4 | 24.2 | <0.01 | <0.05 | <0.05 | <0.01 | <0.2 |

Values in Table 1 indicate content by weight percent.

TABLE 2

Composition of Surface treatment compositions

| | Composition of Surface treatment composition (weight percent) | | | | | | | | | | | Oxide Ratios | | |
|---|---|---|---|---|---|---|---|---|---|---|---|---|---|---|
| No. | $CaCO_3$ | $CaSO_4$ | $CaCl_2$ | $BaCO_3$ | $BaSO_4$ | $SiO_2$ | $B_2O_3$ | Sct *1 | Bsc *2 | $Fe_2O_3$ | $Li_2CO_3$ | R1 *3 | R2 *4 | Note |
| 1 | 100 | | | | | | | | | | | ∞ | 0 | For comparison |
| 2 | | | 100 | | | | | | | | | ∞ | 0 | |
| 3 | | | | | 100 | | | | | | | ∞ | 0 | |
| 4 | 96 | | | | | 4 | | | | | | 13.4 | 0 | |
| 5 | 75 | | | | | 25 | | | | | | 1.7 | 0 | |
| 6 | 96 | | | | | | 4 | | | | | 13.4 | 0 | |
| 7 | 75 | | | | | | 25 | | | | | 1.7 | 0 | |
| 8 | | | | | 95 | 5 | | | | | | 12.5 | 0 | |
| 9 | | | | | 70 | 30 | | | | | | 1.5 | 0 | |
| 10 | 94 | | | | | | | | | 6 | | ∞ | 0.102 | |
| 11 | 85 | | | | | | | | | | 15 | ∞ | 0.097 | |
| 12 | 94 | | | | | 6 | | | | | | 8.8 | 0 | EXAMPLES of this invention |
| 13 | 80 | | | | | 20 | | | | | | 2.2 | 0 | |
| 14 | 94 | | | | | | 6 | | | | | 8.8 | 0 | |
| 15 | 80 | | | | | | 20 | | | | | 2.2 | 0 | |
| 16 | | | | | 93 | 7 | | | | | | 8.7 | 0 | |
| 17 | | | | | 75 | 25 | | | | | | 2.0 | 0 | |
| 18 | | 90 | | | | 10 | | | | | | 3.7 | 0 | |
| 19 | | | 90 | | | 10 | | | | | | 4.5 | 0 | |
| 20 | | | | 90 | | 10 | | | | | | 7.0 | 0 | |

TABLE 2-continued

| | Composition of Surface treatment compositions | | | | | | | | | | | | | |
|---|---|---|---|---|---|---|---|---|---|---|---|---|---|---|
| | Composition of Surface treatment composition (weight percent) | | | | | | | | | | | Oxide Ratios | | |
| No. | $CaCO_3$ | $CaSO_4$ | $CaCl_2$ | $BaCO_3$ | $BaSO_4$ | $SiO_2$ | $B_2O_3$ | Sct *1 | Bsc *2 | $Fe_2O_3$ | $Li_2CO_3$ | R1 *3 | R2 *4 | Note |
| 21 | | | | | 90 | 10 | | | | | | 5.9 | 0 | |
| 22 | 80 | | | | 10 | 10 | | | | | | 5.1 | 0 | |
| 23 | 78 | | | | 10 | | | 12 | | | | 6.3 | 0 | |
| 24 | 78 | | | | 10 | | | | 18 | | | 4.1 | 0 | |
| 25 | 72 | | | | 10 | | | 12 | | 6 | | 5.9 | 0.092 | |
| 26 | 63 | | | | 10 | | | 12 | | | 15 | 5.3 | 0.088 | |

*1: $Na_2O.2SiO_2$;
*2: $Na_2O.B_2O_3SiO_2$;
*3: $\{(CaO) + (BaO)\}/\{(SiO_2) + (B_2O_3)\}$
*4: $\{(Fe_2O_3) + (Li_2O)\}/\{(CaO) + (BaO) + (SiO_2) + (B_2O_3) + (Fe_2O_3) + (Li_2O)\}$

TABLE 3

| Surface Deterioration Rate of Hot-Rolled Steel Sheet not of this Invention (For Comparison) | | | | | |
|---|---|---|---|---|---|
| Id. No. of Steel | Id. No. of Surface treatment composition | Temp. in Heating Furnace | Shot Blasting | Surface Deterior-ation (%) | Loss in Hot-Rolling Step (% by weight) |
| 6 | Not Used | 1,170° C. | Not | 81 | 1.9 |
| 6 | 1 | 1,170° C. | Not | 73 | 4.2 |
| 6 | 2 | 1,170° C. | Not | 75 | 4.1 |
| 6 | 3 | 1,170° C. | Not | 80 | 4.4 |
| 6 | 4 | 1,170° C. | Not | 76 | 4.0 |
| 6 | 5 | 1,170° C. | Not | 80 | 1.9 |
| 6 | 6 | 1,170° C. | Not | 76 | 4.1 |
| 6 | 7 | 1,170° C. | Not | 81 | 1.8 |
| 6 | 8 | 1,170° C. | Not | 74 | 4.0 |
| 6 | 9 | 1,170° C. | Not | 81 | 2.1 |
| 6 | 10 | 1,170° C. | Not | 78 | 4.0 |
| 6 | 11 | 1,170° C. | Not | 82 | 4.0 |
| 6 | 1 | 1,170° C. | Performed | 85 | 4.4 |
| 1 | Not Used | 1,170° C. | Not performed | 5 | 3.7 |
| 1 | 1 | 1,170° C. | Not performed | 7 | 4.8 |
| 2 | Not Used | 1,170° C. | Not performed | 15 | 3.2 |
| 2 | 2 | 1,170° C. | Not performed | 14 | 4.7 |
| 3 | Not Used | 1,170° C. | Not performed | 20 | 2.9 |
| 3 | 3 | 1,170° C. | Not performed | 18 | 4.2 |
| 4 | Not Used | 1,170° C. | Not performed | 45 | 2.4 |
| 4 | 1 | 1,170° C. | Not performed | 40 | 4.1 |
| 5 | Not Used | 1,170° C. | Not performed | 43 | 2.2 |
| 5 | 2 | 1,170° C. | Not performed | 46 | 4.1 |
| 7 | Not Used | 1,170° C. | Not performed | 92 | 1.8 |
| 7 | 3 | 1,170° C. | Not performed | 90 | 4.2 |
| 8 | Not Used | 1,170° C. | Not performed | 100 | 1.6 |
| 8 | 1 | 1,170° C. | Not performed | 100 | 3.7 |
| 9 | Not Used | 1,240° C. | Not performed | 48 | 2.3 |
| 9 | 2 | 1,240° C. | Not performed | 46 | 4.3 |
| 10 | Not Used | 1,240° C. | Not performed | 100 | 1.7 |

TABLE 3-continued

| Surface Deterioration Rate of Hot-Rolled Steel Sheet not of this Invention (For Comparison) | | | | | |
|---|---|---|---|---|---|
| Id. No. of Steel | Id. No. of Surface treatment composition | Temp. in Heating Furnace | Shot Blasting | Surface Deterior-ation (%) | Loss in Hot-Rolling Step (% by weight) |
| 10 | 3 | 1,240° C. | Not performed | 100 | 3.6 |

TABLE 4

| Surface Deterioration Rate of Hot-Rolled Steel Sheet in Accordance with this Invention | | | | | |
|---|---|---|---|---|---|
| Id. No. of Steel | Id. No. of Surface treatment composition | Temp. in Heating Furnace | Shot Blasting | Surface Deterior-ation (%) | Loss in Hot-Rolling Step (% by weight) |
| 6 | 12 | 1,170° C. | Not | 22 | 2.4 |
| 6 | 13 | 1,170° C. | Not | 21 | 2.1 |
| 6 | 14 | 1,170° C. | Not | 24 | 2.3 |
| 6 | 15 | 1,170° C. | Not | 23 | 2.2 |
| 6 | 16 | 1,170° C. | Not | 20 | 2.4 |
| 6 | 17 | 1,170° C. | Not | 21 | 2.2 |
| 6 | 18 | 1,170° C. | Not | 19 | 2.3 |
| 6 | 19 | 1,170° C. | Not | 25 | 2.1 |
| 6 | 20 | 1,170° C. | Not | 21 | 2.1 |
| 6 | 21 | 1,170° C. | Not | 26 | 2.2 |
| 6 | 22 | 1,170° C. | Not | 21 | 2.3 |
| 6 | 23 | 1,170° C. | Not | 11 | 2.2 |
| 6 | 24 | 1,170° C. | Not | 13 | 2.3 |
| 6 | 25 | 1,170° C. | Not | 7 | 2.2 |
| 6 | 26 | 1,170° C. | Not | 6 | 2.3 |
| 6 | 23 | 1,170° C. | Performed | 1 | 2.1 |
| 6 | 23 | 1,220° C. | Not | 18 | 2.8 |
| 1 | 12 | 1,170° C. | Not performed | 1 | 3.8 |
| 1 | 23 | 1,170° C. | Not performed | 0 | 3.6 |
| 2 | 13 | 1,170° C. | Not performed | 3 | 3.4 |
| 2 | 24 | 1,170° C. | Not performed | 0 | 3.5 |
| 3 | 14 | 1,170° C. | Not performed | 7 | 3.1 |
| 3 | 25 | 1,170° C. | Not performed | 0 | 3.1 |
| 4 | 15 | 1,170° C. | Not performed | 12 | 2.4 |

TABLE 4-continued

Surface Deterioration Rate of Hot-Rolled Steel Sheet in Accordance with this Invention

| Id. No. of Steel | Id. No. of Surface treatment composition | Temp. in Heating Furnace | Shot Blasting | Surface Deterioration (%) | Loss in Hot-Rolling Step (% by weight) |
|---|---|---|---|---|---|
| 4 | 25 | 1,170° C. | Not performed | 0 | 2.6 |
| 5 | 16 | 1,170° C. | Not performed | 15 | 2.5 |
| 5 | 26 | 1,170° C. | Not performed | 1 | 2.4 |
| 7 | 17 | 1,170° C. | Not performed | 36 | 1.9 |
| 7 | 21 | 1,170° C. | Not performed | 32 | 2.0 |
| 7 | 26 | 1,170° C. | Not performed | 2 | 2.0 |
| 8 | 18 | 1,170° C. | Not performed | 42 | 1.8 |
| 8 | 26 | 1,170° C. | Not performed | 16 | 1.9 |
| 8 | 26 | 1,170° C. | Performed | 3 | 2.0 |
| 9 | 19 | 1,240° C. | Not performed | 18 | 2.5 |
| 9 | 22 | 1,240° C. | Not performed | 15 | 2.6 |
| 9 | 26 | 1,240° C. | Not performed | 0 | 2.5 |
| 10 | 20 | 1,240° C. | Not performed | 49 | 1.9 |
| 10 | 26 | 1,240° C. | Not performed | 12 | 1.8 |
| 10 | 26 | 1,240° C. | Performed | 4 | 1.8 |
| 10 | 26 | 1,190° C. | Performed | 2 | 1.6 |

What is claimed is:

1. A process for hot-rolling a stainless steel slab, comprising heating a stainless steel slab containing at least about 10 weight percent chromium in a heating furnace and hot-rolling the slab; wherein prior to said heating a surface treatment composition is applied to at least one surface of said slab, said composition comprising a mixture of (a) at least one member selected from the group consisting of a Ca compound and a Ba compound and (b) a binder for binding the mixture to a slab surface and for forming a coating film, wherein the binder comprises at least one member selected from the group consisting of a Si compound and a B compound, and wherein the surface treatment composition has a composition satisfying the relationship $$2 \leqq (1.4Ca+1.1Ba)/(2.1Si+3.2B) \leqq 10$$

wherein Ca, Ba, Si and B indicate the elemental Ca, Ba, Si and B contents by weight percent contained in the surface treatment composition, respectively.

2. The process according to claim 1, wherein the stainless steel contains at least one element selected from the group consisting of aluminum, molybdenum, titanium, and niobium, in a total amount of at least about 0.2 weight percent.

3. The process according to claim 1, wherein the stainless steel contains at least about 16 weight percent chromium.

4. The process according to claim 1, wherein the Si compound is a silicate and the B compound is a borosilicate.

5. The process according to claim 2, wherein the Si compound is a silicate and the B compound is a borosilicate.

6. The process according to claim 3, wherein the Si compound is a silicate and the B compound is a borosilicate.

7. The process according to claim 1, wherein the surface treatment composition contains at least one member selected from the group consisting of an Fe compound and a Li compound according to the relationship $$0.02 \leqq (1.4Fe+2.2Li)/(1.4Ca+1.1Ba+2.1Si+3.2B+1.4Fe+2.2Li) \leqq 0.3$$

wherein Ca, Ba, Si, B, Fe and Li indicate the elemental Ca, Ba, Si, B, Fe and Li contents by weight percent contained in the surface treatment composition, respectively.

8. The process according to claim 2, wherein the surface treatment composition contains at least one member selected from the group consisting of an Fe compound and a Li compound according to the relationship $$0.02 \leqq (1.4Fe+2.2Li)/(1.4Ca+1.1Ba+2.1Si+3.2B+1.4Fe+2.2Li) \leqq 0.3$$

wherein Ca, Ba, Si, B, Fe and Li indicate the elemental Ca, Ba, Si, B, Fe and Li contents by weight percent contained in the surface treatment composition, respectively.

9. The process according to claim 3, wherein the surface treatment composition contains at least one member selected from the group consisting of an Fe compound and a Li compound according to the relationship $$0.02 \leqq (1.4Fe+2.2Li)/(1.4Ca+1.1Ba+2.1Si+3.2B+1.4Fe+2.2Li) \leqq 0.3$$

wherein Ca, Ba, Si, B, Fe and Li indicate the elemental Ca, Ba, Si, B, Fe and Li contents by weight percent contained in the surface treatment composition, respectively.

10. The process according to claim 1, wherein the surface treatment composition is applied after residual oxide flux adhering to the slab surface from casting is removed.

11. The process according to claim 2, wherein the surface treatment composition is applied after residual oxide flux adhering to the slab surface from casting is removed.

12. The process according to claim 3, wherein the surface treatment composition is applied after residual oxide flux adhering to the slab surface from casting is removed.

13. The process according to claim 1, wherein the stainless steel slab is heated to a temperature less than 1,200° C.

14. The process according to claim 2, wherein the stainless steel slab is heated to a temperature less than 1,200° C.

15. The process according to claim 3, wherein the stainless steel slab is heated to a temperature less than 1,200° C.

* * * * *